US008251781B2

(12) United States Patent
Hagiwara

(10) Patent No.: US 8,251,781 B2
(45) Date of Patent: Aug. 28, 2012

(54) SANDER

(75) Inventor: Hirokazu Hagiwara, Anjo (JP)

(73) Assignee: Makita Corporation, Anjo (JP)

( * ) Notice: Subject to any disclaimer, the term of this patent is extended or adjusted under 35 U.S.C. 154(b) by 423 days.

(21) Appl. No.: 12/709,025

(22) Filed: Feb. 19, 2010

(65) Prior Publication Data

US 2010/0233944 A1 Sep. 16, 2010

(30) Foreign Application Priority Data

Mar. 10, 2009 (JP) ..... 2009-056876

(51) Int. Cl.
*B24B 23/04* (2006.01)
*B24D 15/00* (2006.01)

(52) U.S. Cl. ..... 451/356; 451/514; 451/517; 451/520

(58) Field of Classification Search ..... 451/356, 451/357, 514, 517, 519, 520–522
See application file for complete search history.

(56) References Cited

FOREIGN PATENT DOCUMENTS

JP U-53-20796 5/1978

*Primary Examiner* — Dung Van Nguyen
(74) *Attorney, Agent, or Firm* — Oliff & Berridge, PLC

(57) ABSTRACT

A clamp device for a sander includes: a clamp body slidable on a plate between a clamping position and an unclamping position at which positions a clamp strip contacts with or is away from a side surface of the plate; a support shaft provided on the plate close to the clamp body; an operating member having a first and second ends and rotatably connected to the support shaft, the first end being a connecting end connected to the clamp body, and the second end being an operating end extending above the clamp body, so that the operating member is elastically deformable in an expanding and contracting directions between the connecting end and the operating end; and an engagement member provided on the plate opposite to the support shaft and engageable with the operating end of the operating member while an intermediate portion of the operating member is being compressed.

13 Claims, 5 Drawing Sheets

A–A

B–B

SANDER

BACKGROUND OF THE INVENTION

This application claims the entire benefit of Japanese Patent Application Number 2009-056876 filed on Mar. 10, 2009, the entirety of which is incorporated by reference.

1. Field of the Invention

The present invention relates to a sander equipped with a clamp device for a sanding sheet.

2. Description of Related Art

Various techniques for sanders have been disclosed in the art for clamping a sanding sheet with respect to a sander. For example, Japanese Utility Model Publication No. S53-020796 discloses a paper clamping device for a sander. The paper clamping device comprises a metal clamp 15 provided on a plate 8 through a spring 20 so as to be urged in a closed direction by the resilient force of the spring 20, and an elastic material 21 positioned between the metal clamp 15 and a paper-hanging plate 14 protruding upward from an end portion of a sanding plate 9. A paper 13 is clamped between the elastic material 21 and the metal clamp 15, and when the elastic material 21 undergoes a compressive deformation, the paper 13 is further pulled and tensed in accordance with the amount of compressive deformation.

However, according to the aforementioned paper clamping device disclosed in Japanese Utility Model Publication No. S53-020796, the metal clamp 15 is configured such that an operating plate member 17 is rotatable around a pivot axis 19 which is transversely mounted on the sanding plate 9 via a bracket 18. For this reason, the operating plate member 17 has to extend upward from the sanding plate 9. This may disadvantageously cause an operator to operate the operating plate member 17 by mistake during the sanding operation. However, reducing the length of the operating plate member 17 would result in an increase in the operating load for the operating plate member 17, so that the operator is required a great deal of effort for a single-handed operation and thus the setting operation becomes arduous. Especially, if the operator releases his hand from the operating plate member 17, the operating plate member 17 returns to the clamping position by the resilient action of the spring 20. Therefore, upon attachment and/or removal of the paper 13, the operator is always required to hold the operating plate member 17 in the unclamping position. This results in deterioration of the operability.

In view of the above disadvantages, the present invention seeks to provide a sander which can reduce the operating load without decreasing reliability for clamping a sanding sheet as well as ease the setting operation.

The present invention has been made in an attempt to eliminate the above disadvantages, and illustrative, non-limiting embodiments of the present invention overcome the above disadvantages and other disadvantages not described above.

SUMMARY OF THE INVENTION

In order to achieve the above object, according to the present invention, there is provided a sander comprising: a main body in which a motor is housed; a rectangular plate provided below the main body and configured to move in a circular motion on a flat plane when the motor is driven; and a pair of clamp devices provided at opposite side surfaces of the plate, each clamp device being configured to be capable of clamping one end portion of a sanding sheet to be positioned on a bottom surface of the plate. Each clamp device comprises: a clamp body having a clamp strip extending along the side surface of the plate and configured to be slidable on the plate between a clamping position where the clamp strip contacts with the side surface and an unclamping position where the clamp strip is away from the side surface; a support shaft provided on the plate at a position close to the clamp body and extending in a vertical direction; an operating member having a first end, a second end, and an intermediate portion positioned between the first end and the second end and rotatably connected to the support shaft, the first end being a connecting end connected to the clamp body, and the second end being folded back at the support shaft and being an operating end extending above the clamp body, so that the operating member is elastically deformable in an expanding and contracting directions as seen from top between the connecting end and the operating end; and an engagement member provided on the plate opposite to the support shaft with the clamp body interposed therebetween, and configured to be engageable with the operating end of the operating member while the intermediate portion is being compressed, wherein while the end portion of the sanding sheet is positioned between the clamp strip and the side surface of the plate, the operating end is brought into engagement with the engagement member so that the intermediate portion is compressed and the clamp body connected to the connecting end is urged from the unclamping position to the clamping position to thereby secure the end portion under pressure between the clamp strip and the side surface of the plate.

According to one specific embodiment of the present invention, the clamp body is connected to the plate via a guiding mechanism, and the guiding mechanism is configured to guide the clamp strip in such a manner as to be slidable while maintaining a parallel relationship relative to the side surface of the plate.

With the above configuration of the sander according to the present invention, since the operating member is rotatable around the support shaft extending in a vertical direction from the plate, the operating end extending from the support shaft can be enlarged to the extent of the length of one side of the plate, so that the operating load for the clamping operation becomes relatively small. Further, since the clamp strip released by the operator does not return automatically from the unclamping position to the clamping position, setting of the sanding sheet is readily performed.

With the above configuration of the sander according to one specific embodiment of the present invention, in addition to the above advantageous effects of the present invention, notwithstanding the rotational movement of the operating member, the clamp body can perform a smooth linear movement by means of the guiding mechanism. Therefore, attachment and/or removal of the sanding sheet can be performed without deteriorating the operability.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENT

With reference to the accompanying drawings, one preferred embodiment of the present invention will be described in detail.

Figure 1A:
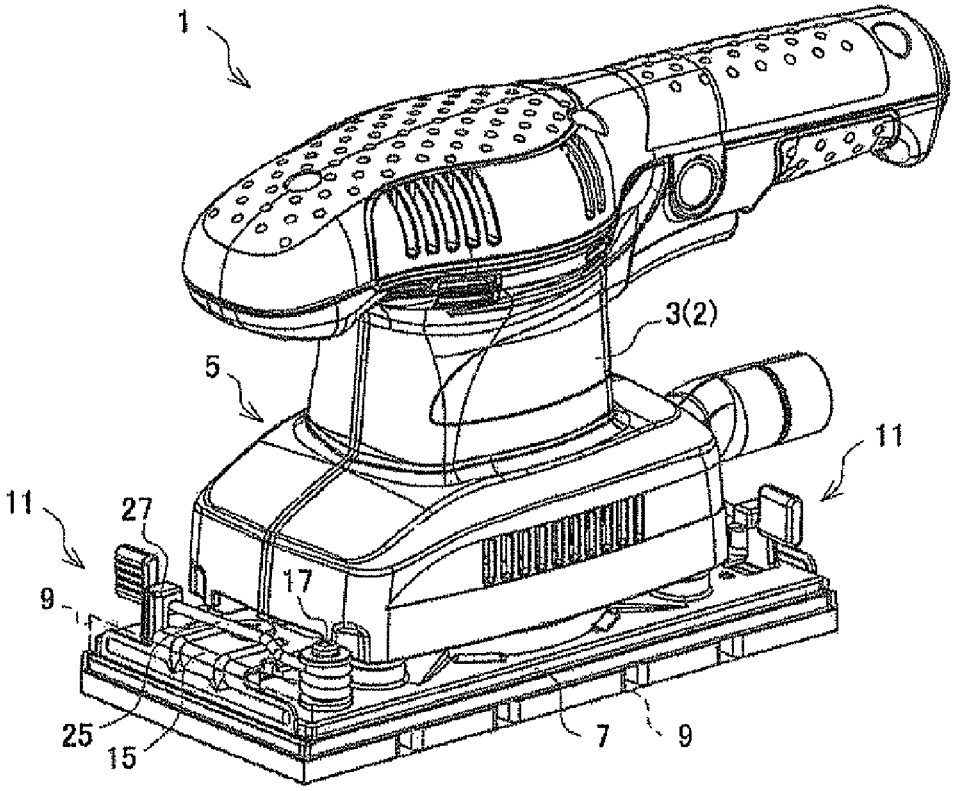
FIG. 1A is a perspective view of a sander according to the present invention explaining that a clamp device is in a clamping position.
Figure 1B:
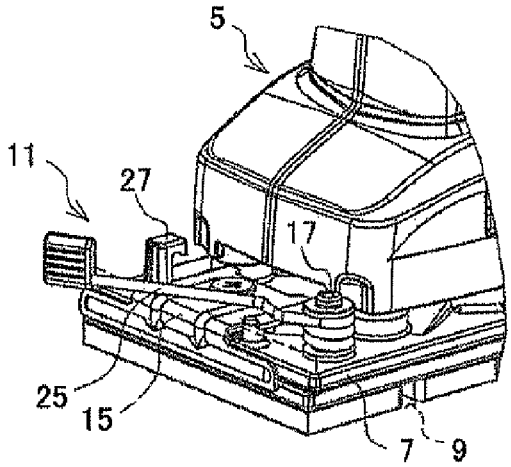
FIG. 1B is a perspective view partially showing the clamp device in an unclamping position.

As seen in FIG. 1, a sander 1 mainly consists of a main body 5 having a housing 3 in which a motor 2 is housed, and a rectangular plate 7 provided below the main body 5 and configured to move in a circular motion on a flat plane when the motor 2 is driven. The main body 5 is arranged substantially at a center part of the plate 7. The plate 7 is formed to have a predetermined thickness, and has two opposite short sides and two opposite long sides. Further, the sander 1 is equipped with a pair of clamp devices 11, 11 provided at opposite short-side surfaces of the plate 7. Each clamp device 11 is configured to be capable of clamping one end portion of a sanding sheet 9 to be positioned on a bottom surface of the plate 7.

As seen in FIGS. 2A, 2B, 3A and 3B, the clamp device 11 is arranged at an installation space on the plate 7, which extends from the short-side surface of the plate 7 to the main body 5 with a predetermined depth.

The clamp device 11 includes: a clamp body 15 having a clamp strip 13 extending along the short-side surface of the plate 7 and configured to be slidable on the plate 7 between a clamping position CP where the clamp strip 13 contacts with the side surface during clamping and an unclamping position UCP where the clamp strip 13 is away from the side surface by a predetermined distance during unclamping; a support shaft 17 provided on the installation space at a position close to the clamp body 15 and extending in the vertical direction; an operating member 25 having a first end, a second end, and an intermediate portion 19 positioned between the first end and the second end and rotatably connected to the support shaft 17, the first end being a connecting end 21 connected to the clamp body 15, and the second end being folded back at the support shaft 17 and being an operating end 23 extending above the clamp body 15, so that the operating member 25 is elastically deformable in an expanding and contracting directions as seen from top between the connecting end 21 and the operating end 23; and an engagement member 27 provided on the installation space opposite to the support shaft 17 with the clamp body 15 interposed therebetween, and configured to be engageable with the operating end 23 of the operating member 25 while the intermediate portion 19 is being compressed.

The clamp strip 13 of the clamp body 15 is formed as an elongated plate member whose length is smaller than that of the short-side surface of the plate 7, and the clamp strip 13 is arranged along the side surface of the plate 7. Further, the clamp strip 13 has an extension strip 14 in the shape of a rectangular plate with short sides whose length is smaller than that of the clamp strip 13 and long sides whose length is smaller than the depth of the installation space. The extension strip 14 is formed by bending the clamp strip 13 substantially at a right angle and extending from an upper edge portion of the clamp strip 13 so as to be positioned parallel with the installation space surface with a predetermined gap.

Figure 3A:
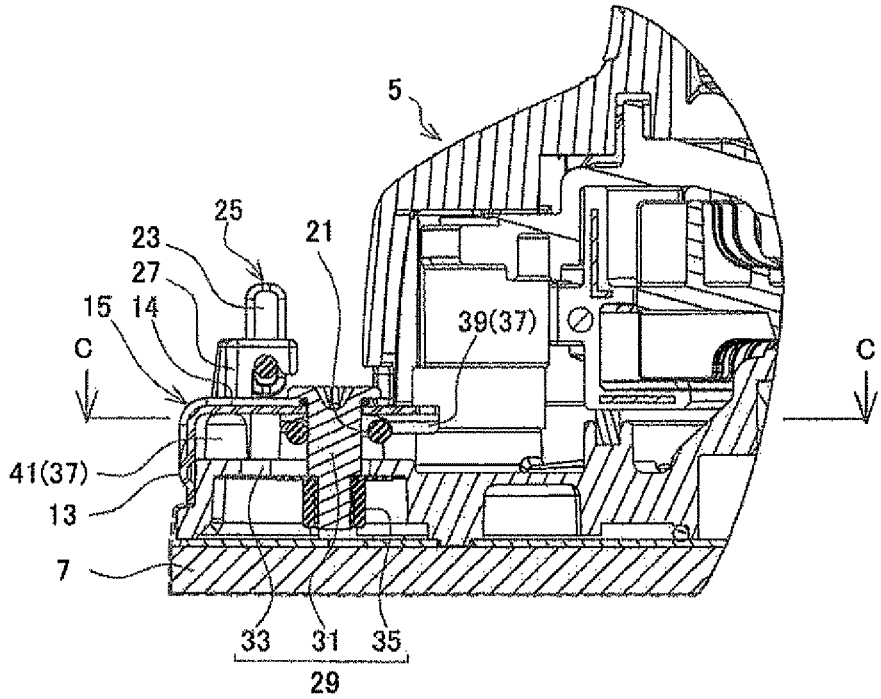
FIG. 3A is an enlarged sectional view taken along the line A-A of FIG. 2A.
Figure 3B:
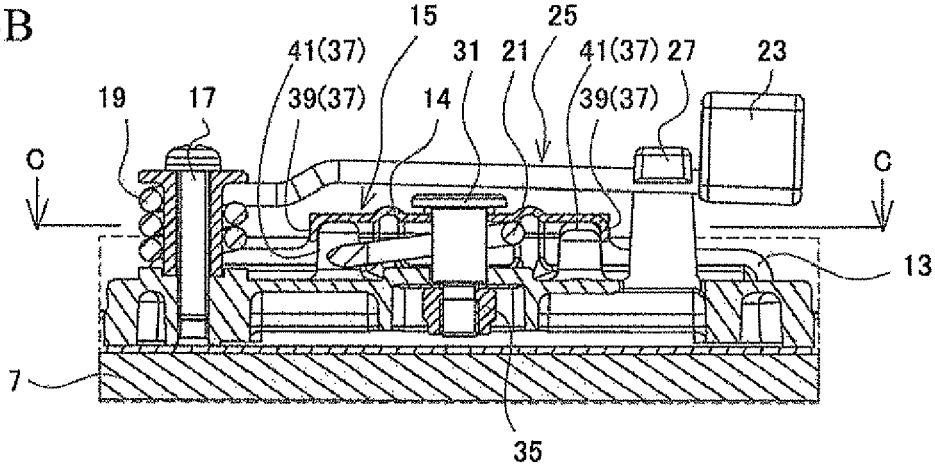
FIG. 3B is an enlarged sectional view taken along the line B-B of FIG. 2A.
Figure 4:
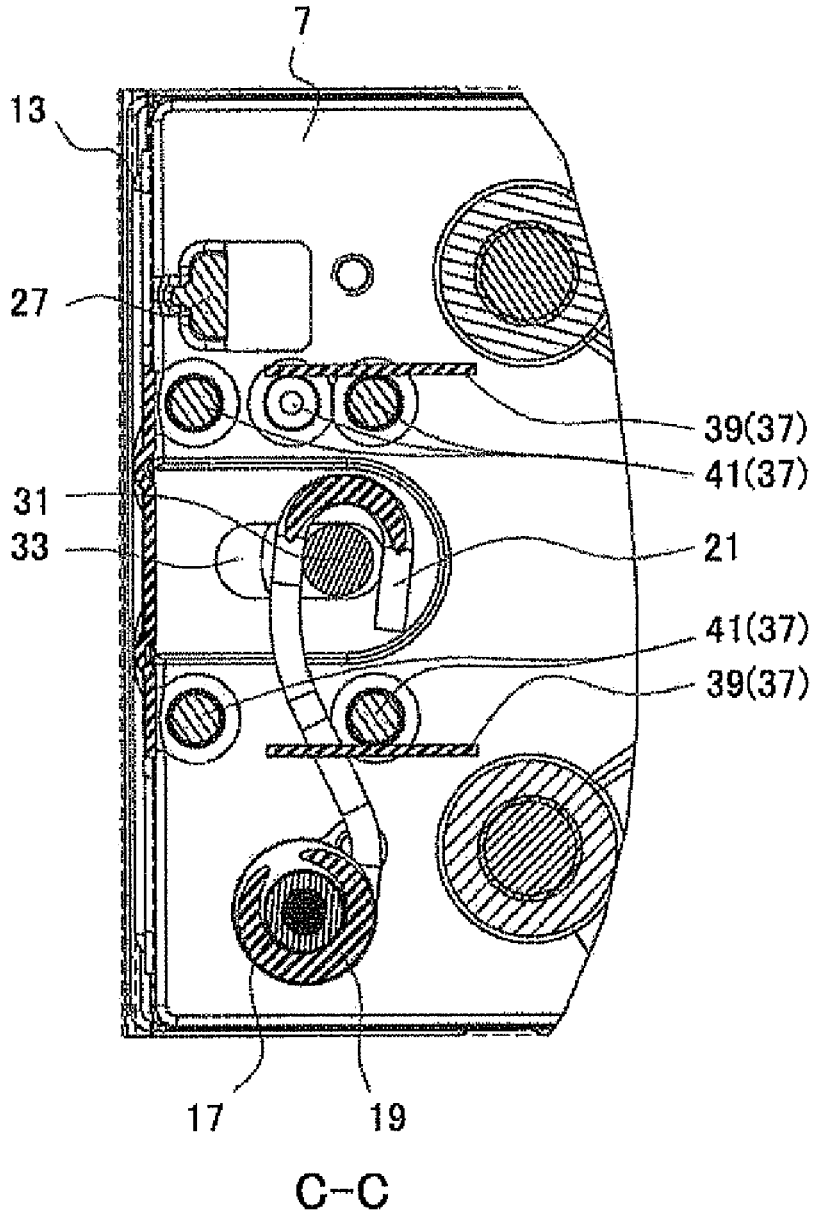
FIG. 4 is a sectional view taken along the line C-C of FIGS. 3A and 3B.

As seen in FIGS. 3A, 3B and FIG. 4, the clamp body 15 is engaged with a connecting mechanism 29 and slidable on the installation space between the clamping position CP and the unclamping position UCP. The connecting mechanism 29 includes: a bolt 31 configured to extend downward from a surface of a center part of the extension strip 14 while penetrating the extension strip 14 and extend toward the installation space surface positioned below the extension strip 14; a connecting groove 33 with a predetermined length for allowing penetration of the bolt 31 and formed in the installation space along the depth direction of the installation space in alignment with a center line of the plate 7; and a retaining ring member 35 positioned below the connecting groove 33 and into which the lower end of the bolt 31 is screwed.

The clamp body 15 is connected to the installation space on the plate 7 via a guiding mechanism 37. The guiding mechanism 37 is configured to guide the clamp strip 13 in such a manner as to be slidable while maintaining a parallel relationship relative to the side surface of the plate 7. The guiding mechanism 37 consists of bent strips 39 formed by bending down both side end portions of the extension strip 14, and guide support members 41 provided on both sides of the connecting groove 33. Each guide support member 41 is configured to support the extension strip 14 while contacting with an inner surface of a corresponding bent strip 39 and a lower surface of a corresponding side end portion, so as to guide the bent strip 39 along the connecting groove 33.

Figure 5:
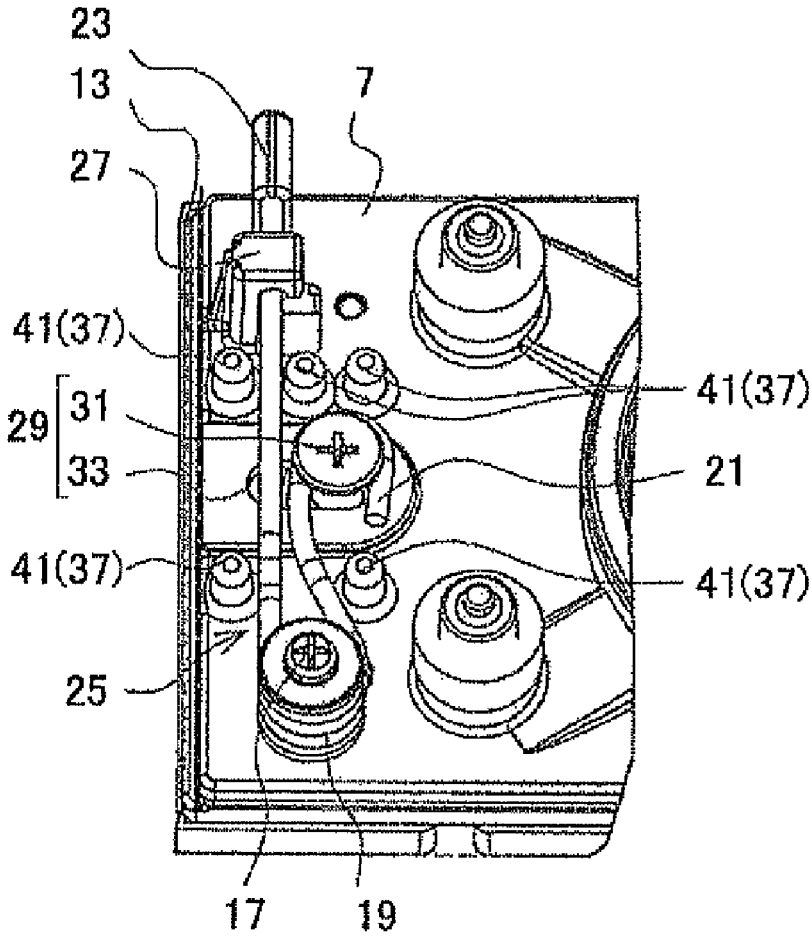
FIG. 5 is a perspective view similar to FIG. 2A but a clamp body of the clamp device is removed.

As best seen in FIG. 5, five guide support members 41 protrude from the installation space so that the extension strip 14 is guided along the guide support members 41 while maintaining a predetermined distance from the installation space.

The operating member 25 is formed by bending an elongated elastically deformable member. To be more specific, an intermediate portion 19 of the elongated elastically deformable member is wound around the support shaft 17 approximately for 2.5 turns while allowing a rotation of the intermediate portion 19, and both ends of the elastically deformable member extend orthogonally from the support shaft 17 at different heights. Of these ends of the elastically deformable member, one end (first end) positioned below the other end (second end) is wound around and connected to a body portion of the bolt 31 as a connecting end 21 in such a manner as to be rotatable around the bolt 31, whereas the other end (second end) positioned above the first end extends horizontally as an operating end 23. The operating member 25 is configured such that when the operating end 23 is operated to rotate around the support shaft 17, the connecting end 21 also rotates in the same direction by the aid of the elastic deformation of the operating member 25 in an expanding and contracting directions between the connecting end 21 and the operating end 23.

The engagement member 27 is provided on the installation space opposite to the support shaft 17 with the extension strip 14 of the clamp body 15 interposed therebetween. The engagement member 27 is a rod-like member having a proximal end and a hook-shaped distal end. The proximal end of the engagement member 27 is fixed to the installation space, and the hook-shaped distal end is engageable with the operating end in such a state where the intermediate portion 19 between the connecting end 21 and the operating end 23 of the operating member 25 is compressed.

Figure 2A:
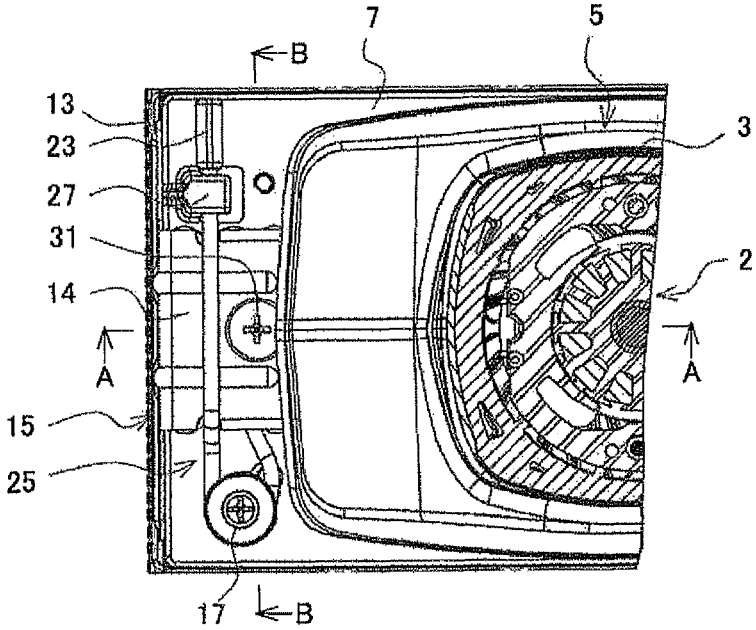
FIG. 2A is a top view partially showing the clamp device in the clamping position.
Figure 2B:
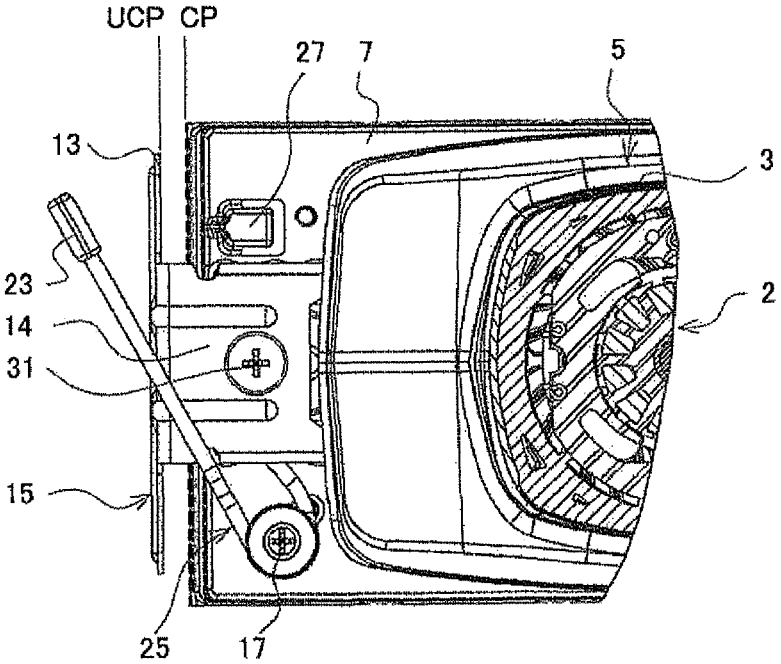
FIG. 2B is a top view partially showing the clamp device in the unclamping position.

According to the sander 1 as described above, when the operating member 23 is not engaged with the engagement member 27, as best seen in FIG. 2B, the clamp body 15 is urged toward the unclamping position UCP by the elasticity of the operating member 25. Upon attachment of the sanding sheet 9, one end portion of the sanding sheet 9 is positioned between the clamp strip 13 and the side surface of the plate 7, and then the operating end 23 is operated to rotate horizontally toward the engagement member 27. This causes the connecting end 21 to rotate horizontally in the same direction as the operating end 23 does, so that the clamp body 15 engaged with the connecting mechanism 29 can be slid to the clamping position CP (see FIG. 2A). When the operating end 23 is further rotated against the elasticity of the operating member 25 and brought into engagement with the engagement member 27, the clamp body 15 is urged toward the clamping position CP by the elasticity of the operating member 25 so that the sanding sheet 9 is tightly secured while being pressed between the clamp strip 13 and the side surface of the plate 7.

On the contrary, upon removal of the sanding sheet 9, the operating end 23 is disengaged from the engagement member 27. This causes, the operating end 23 to rotate outward in the horizontal direction by the elastic deformation of the operating member 25, so that clamp body 15 is slid toward the unclamping position UCP. Therefore, the tightly securement of the sanding sheet 9 between the clamp strip 13 and the side surface of the plate 7 is disengaged, allowing replacement of the sanding sheet 9.

According to the sander 1 as described in the above embodiment, since the operating member 25 is rotatable around the support shaft 17 extending in a vertical direction from the plate 7, the operating end 23 extending from the support shaft 17 can be enlarged to the extent of the length of one side of the plate 7, so that the operating load for the clamping operation becomes relatively small. Further, since the clamp strip 13 released by the operator does not return automatically from the unclamping position UCP to the clamping position CP, setting of the sanding sheet 9 is readily performed. Furthermore, since the clamp device 11 is arranged on the plate 7, setting of the sanding sheet 9 can be performed on an operation work table.

Further, the clamp body 15 is connected to the plate 7 via the guiding mechanism 37, which is configured to guide the clamp strip 13 in such a manner as to be slidable while maintaining a parallel relationship relative to the side surface of the plate 7. Therefore, notwithstanding the rotational movement of the operating member 25, the clamp body 15 can perform a smooth linear movement by means of the guiding mechanism 37, and the attachment and/or removal of the sanding sheet 9 can be performed without deteriorating the operability.

Although the present invention has been described in detail with reference to the above preferred embodiment, the present invention is not limited to the above specific embodiment and various changes and modifications may be made to the shape and/or the configuration of each part without departing from the scope of the appended claims. For example, these changes/modifications may be as follows:

(1) As long as the sanding sheet is a sheet-like clampable material, the sanding sheet is not limited to a paper but may be fabric or the like.

(2) The pair of clamp devices may be provided at opposite long-side surfaces of the plate instead of the opposite short-side surfaces.

(3) The guiding mechanism may be a pair of members corresponding to the bent strips and the guide support members. For example, one or more guide support members may be provided on the extension strip, and members corresponding to the bent strips may be provided on both sides of the connecting groove.

(4) The guide support members of the guiding mechanism are not limited to discontinuous projections, and may be continuous bank-shaped ridges provided on both sides of the connecting groove.

(5) The operating member is not limited to be formed from an elongated elastically deformable member. For example, the operating member may consist of a rotatable member which is rotatably mounted to the support shaft, and a operating end and a connecting end formed from discrete elastically deformable members and respectively attached to the rotatable member.

What is claimed is:

1. A sander comprising:

a main body in which a motor is housed;

a rectangular plate provided below the main body and configured to move in a circular motion on a flat plane when the motor is driven; and a pair of clamp devices provided at opposite side surfaces of the plate, each clamp device being configured to be capable of clamping one end portion of a sanding sheet to be positioned on a bottom surface of the plate, wherein the clamp device comprises:

a clamp body having a clamp strip extending along the side surface of the plate and configured to be slidable on the plate between a clamping position where the clamp strip contacts with the side surface and an unclamping position where the clamp strip is away from the side surface;

a support shaft provided on the plate at a position close to the clamp body and extending in a vertical direction;

an operating member having a first end, a second end, and an intermediate portion positioned between the first end and the second end and rotatably connected to the support shaft, the first end being a connecting end connected to the clamp body, and the second end being folded back at the support shaft and being an operating end extending above the clamp body, so that the operating member is elastically deformable in an expanding and contracting directions as seen from top between the connecting end and the operating end; and an engagement member provided on the plate opposite to the support shaft with the clamp body interposed therebetween, and configured to be engageable with the operating end of the operating member while the intermediate portion is being compressed, wherein while the end portion of the sanding sheet is positioned between the clamp strip and the side surface of the plate, the operating end is brought into engagement with the engagement member so that the intermediate portion is compressed and the clamp body connected to the connecting end is urged from the unclamping position to the clamping position to thereby secure the end portion under pressure between the clamp strip and the side surface of the plate.

2. The sander according to claim 1, wherein the clamp body is connected to the plate via a guiding mechanism configured to guide the clamp strip in such a manner as to be slidable while maintaining a parallel relationship relative to the side surface of the plate.

3. The sander according to claim 2, wherein the clamp body includes an extension strip formed by bending the clamp strip substantially at a right angle and extending from an upper edge portion of the clamp strip, the extension strip being positioned on the plate in such a manner as to be parallel with the plate, and wherein the extension strip is engaged with a connecting mechanism and slidable on the plate.

4. The sander according to claim 3, wherein the connecting mechanism comprises a bolt provided on the plate and configured to penetrate through a center part of the extension strip, and a connecting groove for allowing penetration of the bolt and formed in the extension strip at a predetermined length along a direction where the extension strip is slidable.

5. The sander according to claim 4, wherein the guiding mechanism comprises bent strips formed by bending down both side end portions of the extension strip, and guide support members provided on both sides of the connecting groove, each guide support member being configured to support the extension strip while contacting with an inner surface of a corresponding bent strip and a lower surface of a corresponding side end portion, so as to guide the bent strip along the connecting groove.

6. The sander according to claim 5, wherein the guide support member is a projection provided on the plate.

7. The sander according to claim 1, wherein the operating member is formed by bending an elongated elastically deformable member.

8. The sander according to claim 7, wherein an intermediate portion of the elastically deformable member is wound plural times around the support shaft while allowing a rotation of the intermediate portion, and both ends of the elastically deformable member extend orthogonally from the support shaft.

9. The sander according to claim 1, wherein the engagement member is a rod-like member having a hook-shaped end which is engageable with the operating end.

10. The sander according to claim 1, wherein the clamp strip of the clamp body is formed as an elongated plate member whose length is smaller than that of the side surface of the plate.

11. The sander according to claim 10, wherein the extension strip of the clamp body is a rectangular plate member and connected to the clamp strip at one side thereof whose length is smaller than that of the clamp strip.

12. The sander according to claim 1, wherein the main body is arranged substantially at a center part of the plate, and wherein the pair of clamp devices are provided at opposite short-side surfaces of the plate.

13. The sander according to claim 12, wherein each clamp device is arranged at an installation space on the plate, the installation space extending from the short-side surface of the plate to the main body with a predetermined depth.

* * * * *